US010070731B2

(12) United States Patent
Frankel et al.

(10) Patent No.: US 10,070,731 B2
(45) **Date of Patent: *Sep. 11, 2018**

(54) FOLDING CHAIR WITH SIDE BAGS WITH SELF-CONTAINED PACKAGING FUNCTIONALITY

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 77 days.

This patent is subject to a terminal disclaimer.

(21) Appl. No.: 15/229,469

(22) Filed: Aug. 5, 2016

(65) Prior Publication Data

US 2018/0035812 A1 Feb. 8, 2018

(51) Int. Cl.
*A47C 4/28* (2006.01)
*A47C 7/62* (2006.01)

(52) U.S. Cl.
CPC ..... *A47C 7/62* (2013.01); *A47C 4/286* (2013.01)

(58) Field of Classification Search
CPC .. A47C 4/286; A47C 4/28; A47C 4/48; A47C 4/24; A47C 4/283
See application file for complete search history.

(56) References Cited

U.S. PATENT DOCUMENTS 3,000,667 A * 9/1961 Dryden ..... A01K 97/06 297/183.5
6,629,722 B1 * 10/2003 Tang ..... A47C 7/62 297/188.08
7,604,288 B1 * 10/2009 Verhulst ..... A45F 4/02 297/129
8,752,889 B1 * 6/2014 Nievinski ..... F41A 23/14 297/184.11
2004/0227381 A1 * 11/2004 Redzisz ..... A47C 4/283 297/42
2008/0012399 A1 * 1/2008 Lin ..... A47C 4/283 297/188.08
2010/0164256 A1 * 7/2010 Salisbury ..... A47C 4/286 297/16.2
2014/0252817 A1 * 9/2014 Lovley, II ..... A47C 7/66 297/184.15
2014/0312659 A1 * 10/2014 Moon ..... A47C 7/54 297/16.2

(Continued)

*Primary Examiner* — Timothy J Brindley
(74) *Attorney, Agent, or Firm* — Merek, Blackmon & Voorhees, LLC

(57) ABSTRACT

This invention is to a folding chair with side bags that have a self-contained packaging functionality, composed of a folding stand as well as a seat fabric and a backrest fabric fixed to the folding stand. When the folding stand is opened, the seat fabric and the backrest fabric are in an unfolded open state. In a preferred embodiment, corresponding side bags and packing straps are provided at the seat fabric edges or on the handrails on both sides of the chair. Packing straps are provided behind the side bags. Locking mechanisms are provided on the two side bags and two packing straps. When folded, the two side bags will wrap around the outside of the folded chair and the two packing straps will wrap around the rest of the outside of the folded folding stand.

5 Claims, 4 Drawing Sheets

(56) References Cited

U.S. PATENT DOCUMENTS

| | | | | |
|---|---|---|---|---|
| 2015/0230618 | A1* | 8/2015 | Scott | A47C 4/286<br>297/180.13 |
| 2017/0127837 | A1* | 5/2017 | Brune | A47C 4/28 |
| 2018/0027970 | A1* | 2/2018 | Frankel | A47C 4/30 |

* cited by examiner

FOLDING CHAIR WITH SIDE BAGS WITH SELF-CONTAINED PACKAGING FUNCTIONALITY

This invention is to the field of folding furniture. Specifically, it is to a type of folding chair with side bags that have a self-contained packaging function. The bags can be used to pack up the folded folding chair and they also provide space to accommodate objects.

BACKGROUND OF THE INVENTION

Technical Background

Existing folding chairs are widely used. They are used to sit in or repose on by people at leisure or engaged in outdoor activities. Currently there are two types of folding forms. One is a flat folding form in which the folding chair has a planar structure after it is folded. This type of folding chair is generally suitable for use in gardens and other relatively stable environments. The second type is a three-dimensional folding form, which means that it folds completely. It can be folded into a bundle and is easy to carry, especially in outdoor activities. It has become a standard tool for outdoor sports. Three-dimensional folding chairs are equipped with side bags. These side bags can be used to pack up the folding chair when it is folded into a bundle. The side bags also restrain the folding stand so that it does not open up, making it hard to carry and store and also greatly reduces the volume occupied by the stand. A three-dimensional folding chair is composed of a folding stand as well as a seat fabric and a backrest fabric that are hung on the stand. Each face of the folding stand is linked by crossing articulated diagonal bar sets. The diagonal bar points in neighboring faces are articulated by the upper corner plate and the lower corner plate and other components, forming a linked integrated structure. Once the positions of two particular intersecting diagonal bars are relatively fixed, the folding stand of a folding chair cannot be opened, which makes it convenient to pack and store the folding chair. By contrast, the traditional approach to packing up this kind of chair is to use a separate bag. For this sort of finished product, the overall condition is good, but the bag is separate from the chair and it is easily lost in the use process, causing inconvenience during re-storage and re-packing of the chair. How to solve this problem is the object of research of this invention.

SUMMARY OF THE INVENTION

The invention was produced with the intention of designing a type of folding chair with side bags and packing straps at corresponding positions on both sides of the chair. After the chair is folded, the two side bags and the two packing straps wrap around the folded folding stand to form a package by which the chair can be carried.

The technical solution of this invention is achieved as follows: it is a type of folding chair with side bags that have a self-contained packaging function, composed of a folding stand as well as a seat fabric and a backrest fabric fixed to the folding stand. When the folding stand is opened, the seat fabric and the backrest fabric are in an unfolded open state. Its characteristics are that corresponding side bags and packing straps are provided at the seat fabric edges or on the handrails ("arm rests") on both sides of the folding chair. The packing straps are behind the side bags. A corresponding locking mechanism is provided on the two side bags and the two packing straps. When the folding stand is folded, the two side bags will wrap around part of the outside of the folded folding stand in opposite directions to form an interlocking mechanism and the two packing straps will wrap around the rest of the outside of the folded folding stand in opposite directions to form an interlocking mechanism, forming a binding packaging structure with the side bags and the packing straps.

The above mentioned locking mechanism is preferably selected from one of the following structures: zippers, buckles, snaps, buttons, Velcro ("hook and loop fasteners"), laces or straps.

The above mentioned side bags can be produced as pockets where objects can be placed, and there will be at least one cup holder to place a cup in.

The above mentioned side bags are preferably positioned at the point where the seat fabric is affixed to the folding stand.

This utility model is ingenious with a reasonable design and is easy to operate. It uses side bags on both sides of the folding chair that can be produced as pockets or cup holders. When we open the folding chair to use it, the bags provide the convenience of holding objects or cups; when we fold the chair, the side bags can act as packaging straps that wrap around the outside of the folding stand to form a binding package. This dual function not only simplifies packaging, but also has strong integrity, eliminating the problem of needing to look around for a packing bag.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

The utility model is further described below with specific illustrations.

Figure 1:
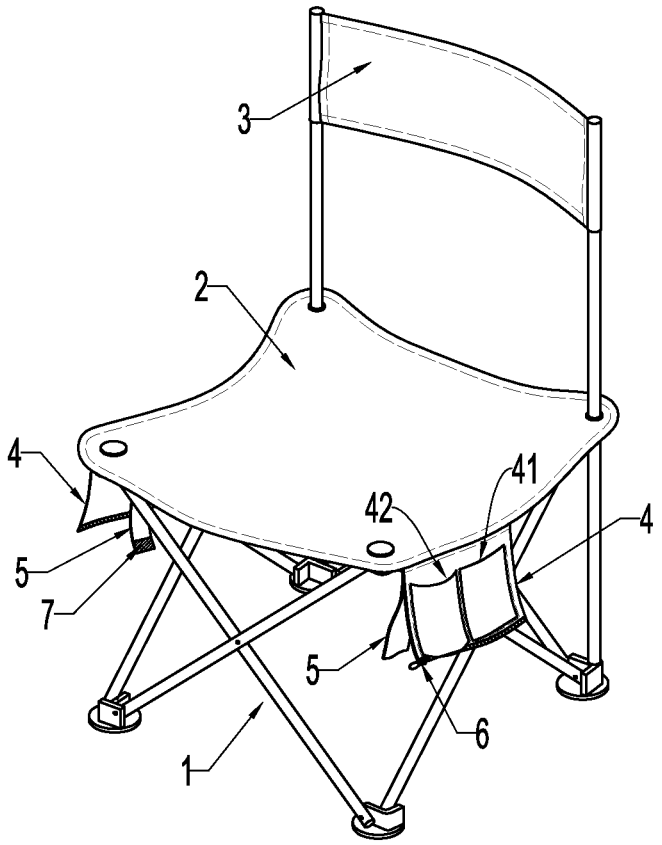
FIG. 1 is a perspective schematic of the folding chair according to a first embodiment.

In the drawings, the following features are described:

1—folding stand
11—support frame
111—handrail
2—seat fabric
3—backrest fabric
4—side bag
41—pocket
42—cup holder
43—hand strap 5—packing strap
6—zipper
7—Velcro Similar reference characters denote corresponding features consistently throughout the attached drawings.

DETAILED DESCRIPTION OF THE PREFERRED EMBODIMENT(S)

Figure 2:
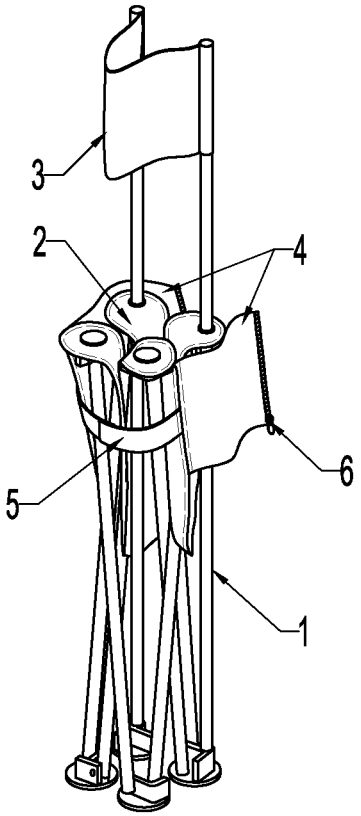
FIG. 2 is a schematic of the folding stand in its folded state
Figure 3:
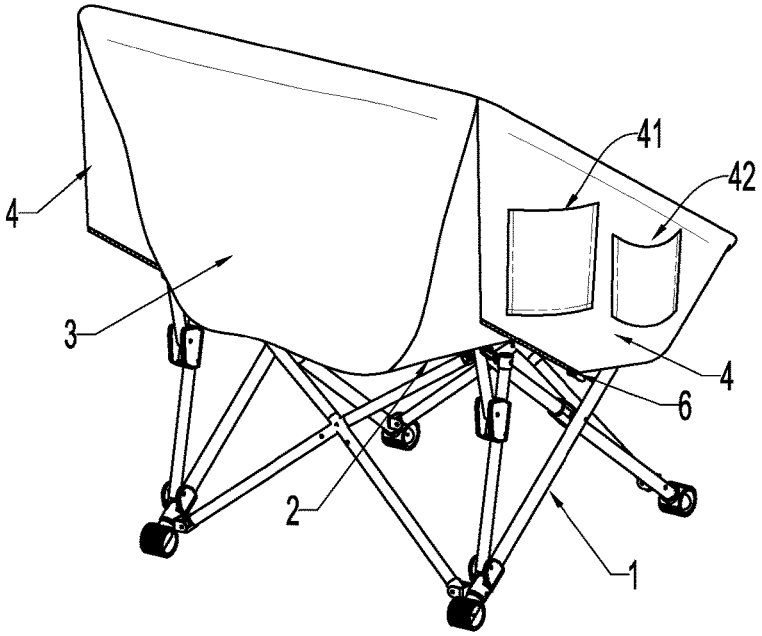
FIG. 3 is a perspective schematic of a Folding Chair according to a second embodiment.
Figure 4:
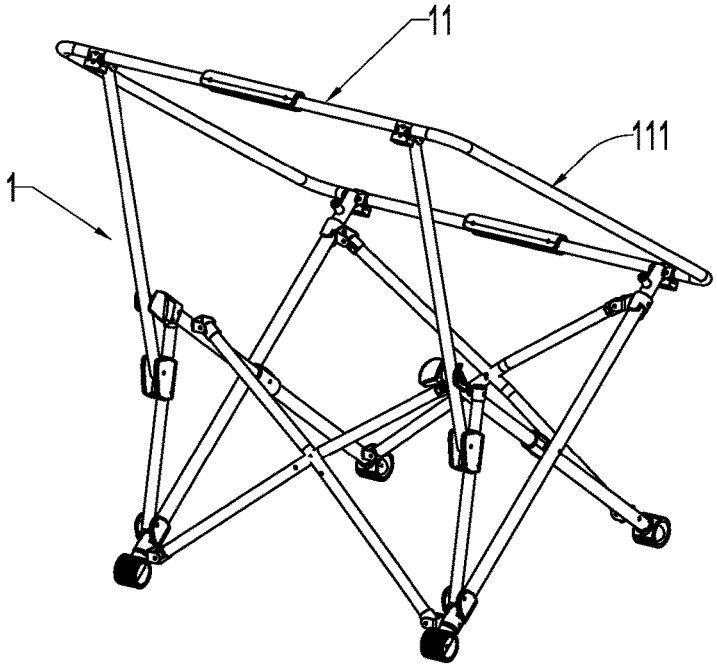
FIG. 4 A perspective schematic of a Folding Stand of the chair of FIG. 3.
Figure 5:
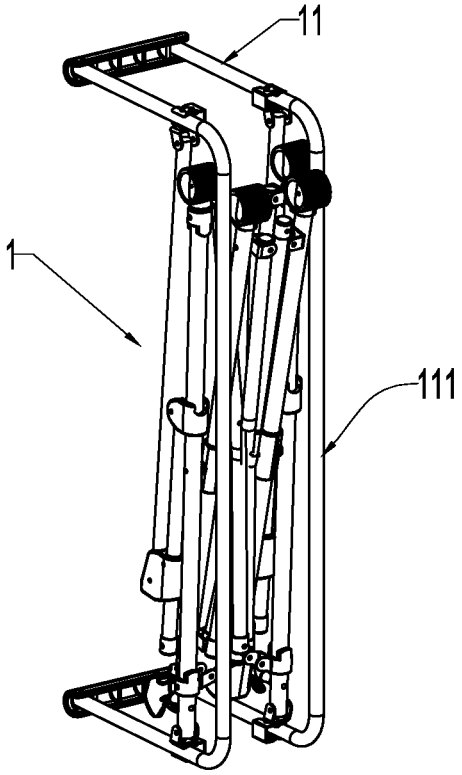
FIG. 5 A schematic of the folded Folding Stand of the chair of FIG. 3.

Referring to FIGS. 1 and 2, it can be seen that the folding chair with self-contained packaging bags is composed of a folding stand 1 as well as a seat fabric 2 and a backrest fabric 3 fixed onto the folding stand. When the folding stand 1 is opened, the seat fabric 2 and the backrest fabric 3 will be in the "open" state. This sample chair is a folding chair without handrails ("arm rests"). Side bags 4 and packing straps 5 are provided at the edge of seat fabric 2 on both sides of the folding chair. The packing straps 5 are behind the side bags 4. There is a cooperative locking mechanism respectively on side bags 4 and packing straps 5. The locking mechanism could be one of the following structures: zippers, buckles, snaps, buttons, VELCRO ("hook and loop fasteners"), laces or straps. In this sample, the locking mechanism of side bags 4 is a zipper 6 and the locking mechanism of packing straps 5 is VELCRO 7. Packing straps 5 are made of broadside webbing.

When the folding stand 1 is folded, side bags 4 wrap around part of the outside of the folded folding stand in opposite directions and lock it in place with a zipper 6. The two packing straps 5 wrap around the rest of the outside of the folding stand 1 in opposite directions and lock it in place with Velcro 7, forming a binding package structure of the folding stand 1 with side bags 4 and packing straps 5. In this way, there is no need to provide an additional packing or storing bag for the folding chair.

Side bags 4 are positioned at the edge of seat fabric 2 on both sides, such that they are hung on both sides. When this type of folding chair is folded, the seat fabric will be folded for storage. Therefore, the width of side bags 4 should be no larger than half the depth to which the seat fabric 2 hangs when it is folded. The side bags can be placed at the front or rear of the seat. The most preferred option is to have side bags 4 placed at the point where seat fabric 2 is affixed to folding stand 1, that is to say, side bags 4 are close to the support points.

Furthermore, the side bags 4 can be produced as pockets 41 and the chair preferably has at least one cup holder 42 to hold a water cup or bottle. In the most preferred embodiment, one side bag is produced as a pocket 41 and the other side bag produced as a cup holder 42. In this way, there is space to place electronics such as cell phones, pads or books and we also have space for cups or bottles to fully meet users' outdoor recreational needs.

In this sample, the seat fabric 2 is a suspended structure with the suspension support points at the four corners of the stand. This can be applied to folding chairs whose seat fabric is affixed to support bars on both sides. In this case, the side bags and the packing straps are sewn to the edge of seat fabric 2 on both sides and the edge of both sides of seat fabric 2 is provided with a cloth cover. The cloth cover covers the outside of the support bars to form support for the seat fabric.

Referring to FIGS. 3 through 7, we can see that in this sample chair, there is a foldable support frame 11 above the folding stand 1. This support frame 11 spreads open the conjoined seat fabric 2 and backrest fabric 3. In other words, the conjoined backrest fabric 3 and seat fabric 2 are hung on the support frame 11 to form the folding chair on which a person can sit. Furthermore, the two sides of the support frame 11 perform the function of handrails ("armrests") 111 on which to place arms. The two handrails 111 are equipped with corresponding side bags 4 and packing straps 5 with symmetrical beauty. The side bags also provide more pockets to hold objects.

Figure 6:
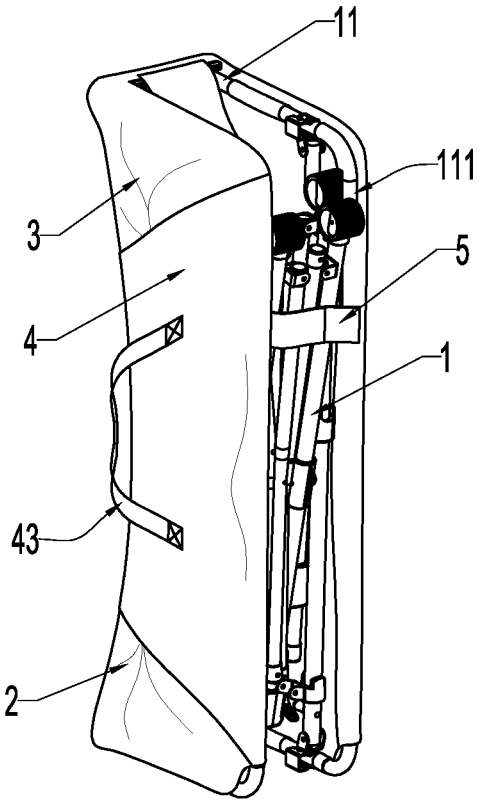
FIG. 6 A schematic of the Folding Chair of FIG. 3 from the back in its folded and packed state.
Figure 7:
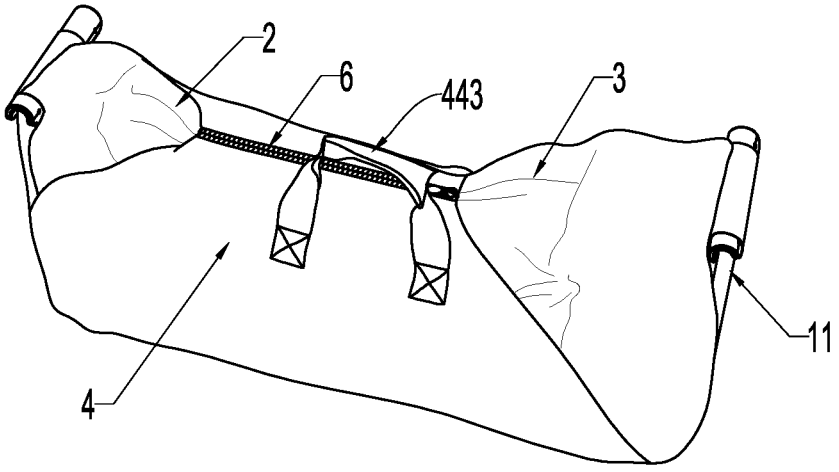
FIG. 7 A schematic of the Folding Chair of FIG. 3 from the front in its folded and packed state.

At the bottom of side bags 4 and the packing straps, there are cooperative locking mechanisms. In this sample, the locking mechanism for side bags 4 is preferably a zipper 6 while the locking mechanism for packing straps is VELCRO 7. When the folding stand 1 is folded, the two side bags 4 will wrap around the outside from both sides in opposite directions to hold part of the folding stand 1 in place; the two packing straps 5 will wrap around the rest of the outside of the folding stand from both sides in opposite directions to hold it in place, as shown in FIG. 6. The two side bags 4 on opposite side with respect to each other wrap around the front of the folding chair in opposite directions and form a protective cover for both the seat fabric 2 and the backrest fabric 3, as shown in FIG. 7. The two packing straps 5 wrap around the back of the folding chair in opposite directions and act as restraints holding the folding stand 1 in place, particularly the foot section of the stand. They serve to pack the folding chair into one whole unit. Therefore, if one moderately enlarges the width of the side bags 4, they can wrap around the majority of the folding chair to protect the seat fabric 2 and backrest fabric 3 from dust and stains. In this sample, a hand strap 43 is sewn to the back of the side bags 4 for convenience of carrying after the chair is folded.

In addition to using VELCRO 7 for the packing straps 5, one can also use an ordinary buckle or directly knot the ends of both packing straps together. In this case, it is preferred to use ordinary cords or laces and to also have two pairs of packing straps.

In this sample, side bags 4 and packing straps 5 are placed at the handrails 111, such that they are sewn to the handrail fabric. This can be applied to any folding chair with handrails to form an integrated folding chair with a self-contained packaging functionality. The best option is to have a pair of side bags 4 and one or two pairs of packing straps 5.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A folding chair, comprising:

a folding stand and a seat fabric and a backrest fabric fixed to the folding stand;

when the folding stand is in a first, open state, the seat fabric and the backrest fabric are unfolded;

a respective side bag is provided at the seat fabric edges or on handrails on opposite sides of the folding chair;

a respective packing strap is attached behind each of the side bags;

a cooperating portion of a locking mechanism is provided on each of the side bags or on each of the packing straps;

wherein when the folding stand is in a second folded state, the side bags surround part of the outside of the folded folding stand in opposite directions and the packing straps surround the rest of the outside of the folded folding stand in opposite directions and the packing straps are secured together by the cooperating portions of the locking mechanism on the packing straps; and wherein when the cooperating portions of the locking mechanism are provided on the side bags, the side bags surround a part of the outside of the folded stand in opposite directions of the folded folding stand and the side bags are secured together by the cooperating portions of the locking mechanism on the side bags.

2. The folding chair of claim 1, wherein the locking mechanism are chosen from the group of zippers, buckles, snaps, buttons, hook and loop fasteners, and lacing straps.

3. The folding chair of claim 1, wherein the side bags are produced as pockets; and further including at least one cup holder to hold a cup.

4. The folding chair of claim 1, wherein the side bags are placed at the point at which the seat fabric is affixed to the folding stand.

5. The folding chair of claim 3, wherein the side bags are placed at the point at which the seat fabric is affixed to the folding stand.

* * * * *